US007159550B2

(12) United States Patent
Maekawa

(10) Patent No.: US 7,159,550 B2
(45) Date of Patent: Jan. 9, 2007

(54) VARIABLE VALVE TRAIN OF INTERNAL COMBUSTION ENGINE

(75) Inventor: Masahiro Maekawa, Tokyo (JP)

(73) Assignees: Mitsubishi Fuso Truck and Bus Corporation (JP); Mitsubishi Jidosha Kogyo Kabushiki Kaisha (JP)

( * ) Notice: Subject to any disclaimer, the term of this patent is extended or adjusted under 35 U.S.C. 154(b) by 0 days.

(21) Appl. No.: 11/286,178

(22) Filed: Nov. 23, 2005

(65) Prior Publication Data

US 2006/0102122 A1 May 18, 2006

Related U.S. Application Data

(63) Continuation of application No. PCT/JP04/03955, filed on Mar. 23, 2004.

(51) Int. Cl.
*F01L 1/18* (2006.01)

(52) U.S. Cl. ..... 123/90.39; 123/90.16; 123/90.44; 74/569

(58) Field of Classification Search ..... 123/90.16, 123/90.2, 90.39, 90.44, 90.6; 74/559, 567, 74/569

See application file for complete search history.

(56) References Cited

U.S. PATENT DOCUMENTS 6,994,063 B1 * 2/2006 Murata ..... 123/90.16

2005/0274340 A1 * 12/2005 Murata

FOREIGN PATENT DOCUMENTS

| | | | |
|---|---|---|---|
| EP | 1 072 761 | A2 | 1/2001 |
| EP | 1 072 762 | A2 | 1/2001 |
| JP | 11-107725 | A | 4/1999 |
| JP | 3245492 | B2 | 10/2001 |
| JP | 2004-27895 | A | 1/2004 |

OTHER PUBLICATIONS

Relevant portion of International Search Report of corresponding PCT Application PCT/JP2004/003955.

* cited by examiner

*Primary Examiner*—Ching Chang
(74) *Attorney, Agent, or Firm*—Kimms & McDowell LLP

(57) ABSTRACT

This variable valve train has a camshaft, a rocker shaft, and a rocker arm mechanism for transmitting a motion of a cam formed on the camshaft to a valve. The rocker arm mechanism includes a first arm which drives the valve, a second arm, a third arm, and a variable mechanism which rocks the rocker shaft. The first arm is rockably supported on the rocker shaft. The second arm is driven by the cam and rocks around a universal joint as a pivot on the side of the rocker shaft. The third arm is displaced to drive the first arm as the second arm rocks.

7 Claims, 6 Drawing Sheets

Lift : Large
Phase : Retarded
(Valve closed)

VARIABLE VALVE TRAIN OF INTERNAL COMBUSTION ENGINE

CROSS-REFERENCE TO RELATED APPLICATIONS

This is a Continuation Application of PCT Application No. PCT/JP2004/003955, filed Mar. 23, 2004, which was published under PCT Article 21(2) in Japanese.

BACKGROUND OF THE INVENTION

1. Field of the Invention

This invention relates to a variable valve train of an internal combustion engine, capable of changing the drive phase of an intake or exhaust valve and the valve lift amount.

2. Description of the Related Art

In order to perform exhaust emission control for an internal combustion engine, such as an automotive engine, or reduce fuel consumption, as is known, the phase or lift amount of a valve of an intake or exhaust system is changed in accordance with the operating state of the internal combustion engine. As a variable valve train to attain this, there is known a vane-type variable-phase valve train in which the cam phase is continuously changed by hydraulic power.

Also known is a valve train of a cam-switching type in which the drive phase and lift amount of a valve is adjusted to the operating state of the internal combustion engine by switching a plurality of types of cams in accordance with the operating state.

Alternatively, as described in Japanese Patent No. 3245492, there is also known a mechanical continuously-variable valve train in which the drive phase and lift amount of a valve can be changed by using a gear that is driven by a stepping motor, an intermediate lever, a return spring, etc.

In the vane-type variable-phase valve train, however, the lift amount of the valve cannot be changed, although the valve drive phase can be shifted by changing the position of the vane.

In the cam-switching valve train or the mechanical continuously-variable valve train, on the other hand, the lift amount and the phase can be shifted. However, the cam-switching valve train requires use of a plurality of types of cams, so that it includes a lot of components and is complicated in construction. Further, the mechanical continuously-variable valve train separately requires a mechanism for changing the lift amount and a mechanism for shifting the phase, so that its construction is complicated and its size is large.

In the case of a conventional continuously-variable-phase valve train, moreover, the valve-opening start timing of an intake valve is also retarded inevitably if the valve closing time is retarded. Thus, a valve overlap between intake and exhaust is reduced or removed, so that a problem arises, such as reduction of fuel efficiency because of pumping loss.

BRIEF SUMMARY OF THE INVENTION

Accordingly, the object of the present invention is to provide a variable valve train capable of continuously changing the drive phase of a valve and the valve lift amount with use of a relatively simple configuration.

A variable valve train of the present invention has a camshaft provided for rotation in an internal combustion engine, a rocker shaft, and a rocker arm mechanism. The rocker arm mechanism comprises a first arm rockably supported on the rocker shaft and configured to drive the intake or exhaust valve, a second arm which is driven by the cam and rocks around a pivot on the side of the rocker shaft, a third arm which is rockably provided on a support shaft located near the rocker shaft and is configured to be displaced to drive the first arm as the second arm rocks, and a variable mechanism which displaces the pivot for the second arm on the side of the rocker shaft.

Since the rotational phase of the second arm with respect to the cam is advanced or retarded in accordance with the position of the pivot of the second arm that is displaced by the variable mechanism, so that the drive phase of the first arm that is driven by means of the second arm and the third arm is advanced or retarded inevitably.

According to this arrangement, the drive phase of the intake or exhaust valve can be continuously changed in accordance with the position of the pivot by displacing the pivot on the rocker shaft side of the second arm by means of the variable mechanism.

In a preferred form of the present invention, the third arm has a transmission surface portion, and this transmission surface portion is provided with a conversion portion at which the distance from the center of the support shaft to the transmission surface portion changes so that the rocking amount of the second arm is converted to drive the first arm.

According to this arrangement, the transmission surface portion of the third arm is provided with the conversion portion at which the distance from the center of the support shaft changes, so that the rocking amount of the second arm can be converted by the third arm and transmitted to the first arm. Thus, the lift amount of the intake or exhaust valve can be changed by moving the position of the pivot on the rocker shaft side of the second arm by means of the variable mechanism.

The variable mechanism displaces the pivot of the second arm by rotating the rocker shaft, and moves a portion of the second arm in contact with the cam in the circumferential direction of a base circle of the cam, thereby changing the rotational phase of the second arm with respect to the cam.

According to this arrangement, the drive phase of the intake or exhaust valve can be continuously changed by means of the variable mechanism that displaces the pivot around the axis of the rocker shaft.

In a preferred form of the present invention, the transmission surface portion has a nonconversion portion at which the distance from the center of the support shaft to the transmission surface portion makes no substantial change in the direction of rotation of the third arm, and the nonconvertible portion cancels a rocking amount of the second arm substantially equivalent to a given angle from the start of rocking motion with the rotational phase of the second arm with respect to the cam advanced for the given angle by the variable mechanism.

According to this arrangement, if the rotational phase of the second arm with respect to the cam is advanced for the given angle by the variable mechanism, the rocking amount of the second arm substantially equivalent to the given angle from the start of the rocking motion is canceled by the nonconvertible portion. Thus, the valve-opening start timing can be made substantially uniform without regard to the valve lift amount.

In a preferred form of the present invention, the second arm has a proximal end portion thereof rotatably supported by a connecting member provided on the side of the rocker shaft, and an abutting portion provided at a part of the second arm and an operating portion provided on the other side of the second arm abut against the cam and the third arm, respectively. A spring is provided on the third arm and urges the third arm to displace the second arm in a direction such that the abutting portion of the second arm abuts against the cam.

According to this arrangement, the spring that is provided to urge the third arm can maintain the respective positions of the second arm and the third arm so that the second arm always abuts against the cam.

In a preferred form of the present invention, the first arm is formed with bifurcate shaft fitting portions, and a part of the second arm is situated between the bifurcate shaft fitting portions. Alternatively, the second arm may be formed with bifurcate proximal end portions, and in this case, a part of the first arm is situated between the proximal end portions.

According to these arrangements, the second arm can be prevented from being displaced in the axial direction of the rocker shaft even if a local load is produced in a contact portion between the second arm and the cam or a contact portion between the second arm and the third arm.

DETAILED DESCRIPTION OF THE INVENTION

Figure 1:
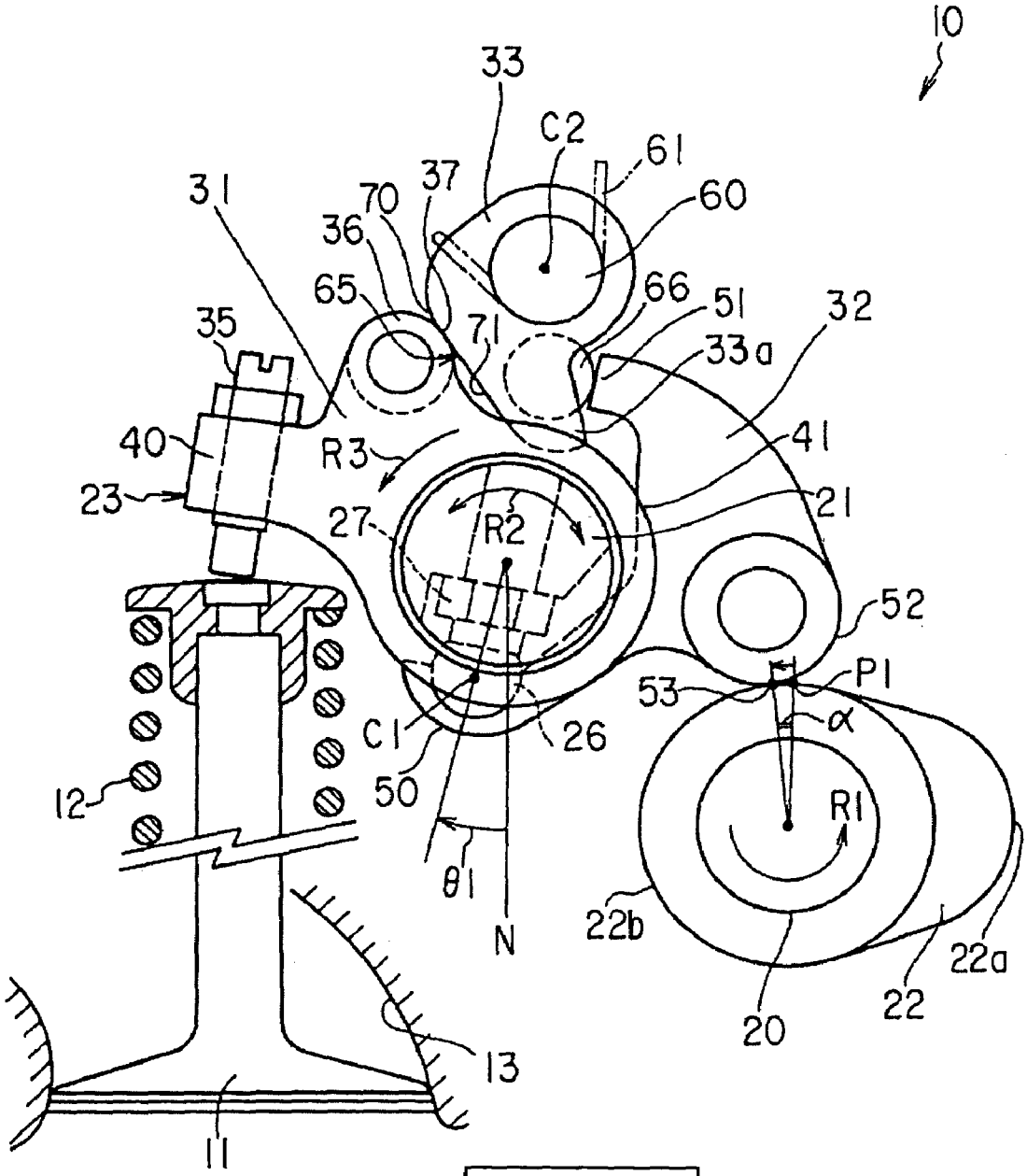
FIG. 1 is a front view showing a valve-closed state of a variable valve train according to a first embodiment of the present invention with its phase delayed.

A first embodiment of the present invention will now be described with reference to FIGS. 1 to 8. A variable valve train 10 shown in FIG. 1 on-off-drives an intake valve 11 that constitutes, for example, an intake system of an internal combustion engine (e.g., automotive engine). The intake valve 11 is urged in a direction to close an intake passage 13 by a valve spring 12. A valve train that resembles the variable valve train 10 may be provided on the exhaust valve side.

The variable valve train 10 comprises a camshaft 20 that provided rotatably on a cylinder head (not shown) of the internal combustion engine, a rocker shaft 21, and a rocker arm mechanism 23 that on-off-drives the valve 11 by rotating a cam 22 formed on the camshaft 20.

The camshaft 20 and the rocker shaft 21 are located so as to extend parallel to each other. The camshaft 20 is configured to rotate in the direction indicated by arrow R1 in FIG. 1 as a crankshaft (not shown) of the internal combustion engine rotates.

The rocker shaft 21 can rock or alternatingly rotate in the directions indicated by arrow R2 in FIG. 1. The rocker shaft 21 is rocked in the directions of arrow R2 by a variable mechanism 25 shown in FIG. 2. The rocker shaft 21 is fitted with a connecting member 27 that has a spherical universal joint 26, such as a stud bolt.

The rocker arm mechanism 23 includes a first arm 31, a second arm 32, and a third arm 33, which will be described below.

The first arm 31 is supported on the rocker shaft 21 for relative rotation (or rocking motion). The first arm 31 is provided with an adjustment screw 35. The distal end of the adjustment screw 35 drives the valve 11 in the valve-opening direction when the camshaft 20 rotates in the direction indicated by arrow R1. This adjustment screw 35 can adjust the first arm 31 and the valve 11 so that there is no play between them. A power transmission portion 37 with a power transmission member 36, such as a roller, is provided near the adjustment screw 35.

Figure 2:
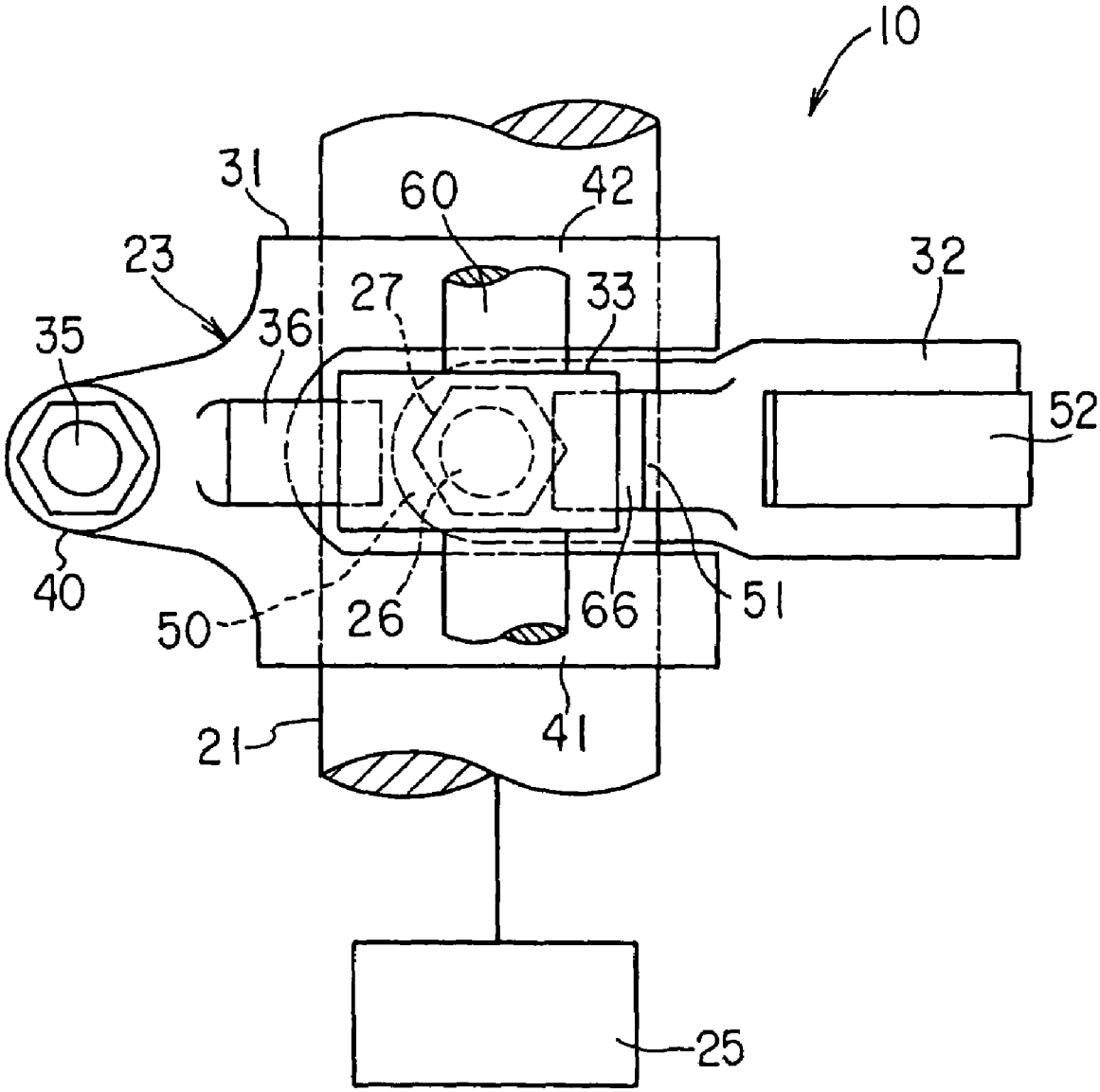
FIG. 2 is a plan view of a part of the variable valve train shown in FIG. 1.

As shown in FIG. 2, the first arm 31 has an end portion 40 on which the adjustment screw 35 is provided and shaft fitting portions 41 and 42 through which the rocker shaft 21 is passed. The shaft fitting portions 41 and 42 are formed bifurcating from the end portion 40.

The second arm 32 is provided between the rocker shaft 21 and the camshaft 20. The second arm 32 has a proximal end portion 50 that is rockably fitted on the universal joint 26 and an operating portion 51 that abuts against a junction portion 66 of the third arm 33, which will be described later.

Provided between the proximal end portion 50 and the operating portion 51 is an abutting portion 53 that has a cam follower 52, such as a roller, which is in rolling contact with the cam 22. As the cam 22 rotates, therefore, the second arm 32 rocks around a center C1 of the universal joint 26 on the side of the rocker shaft 21.

When the rocker shaft 21 is rocked in the directions of arrow R2 by the variable mechanism 25, the proximal end portion 50 of the second arm 32 is displaced in the circumferential direction of the rocker shaft 21. As this is done, the abutting portion 53 is displaced in the circumferential direction of the cam 22, so that the rotational phase of the second arm 32 with respect to the cam 22 can be shifted on the retard side or advance side.

At least a part of the second arm 32 is situated between the shaft fitting portions 41 and 42 when the abutting portion 53 of the second arm 32 abuts against a base circle 22*b* of the cam 22.

According to this configuration in which a part of the second arm 32 is held between the shaft fitting portions 41 and 42, the second arm 32 can be prevented from being displaced in the axial direction of the rocker shaft 21, thereby preventing trouble such as uneven wear, even if a local load is produced in a contact portion between the second arm 32 and the cam 22 or a contact portion between the second arm 32 and the third arm 33.

A support shaft 60 is located near the rocker shaft 21 so as to extend parallel to the rocker shaft 21. The third arm 33 that serves as a transmission cam is rockably provided on the support shaft 60. The third arm 33 is urged by a spring 61 in the counterclockwise direction in FIG. 1, that is, in a direction such that the abutting portion 53 of the second arm 32 is caused to abut against the cam 22.

The third arm 33 is provided with a transmission surface portion 65 that touches the power transmission portion 37 of the first arm 31 and the junction portion 66 that abuts against the operating portion 51 of the second arm 32. The transmission surface portion 65 that serves as a cam surface is displaced in the. rotation direction of the third arm 33, that is, in the circumferential direction of the support shaft 60 as the second arm 32 rocks.

When the second arm 32 rocks, therefore, the position of contact between the power transmission portion 37 and the transmission surface portion 65 shifts in the circumferential direction of the support shaft 60. Thus, when the second arm 32 is rocked around the universal joint 26 toward the third arm 33 by a projection 22*a* of the cam 22 so that the third arm 33 is rotated clockwise by the junction portion 66, the first arm 31 is rotated in the direction of arrow R3 by the transmission surface portion 65, whereupon the valve 11 opens.

More specifically, the transmission surface portion 65 has a nonconversion portion 70 that is kept at a fixed distance from a center C2 of the support shaft 60 and a conversion portion 71 of which the distance from the center C2 of the support shaft 60 increases toward a distal end portion 33*a* of the third arm 33. Thus, the transmission surface portion 65 is formed so that its distance from the center C2 of the support shaft 60 changes with respect to the direction of rotation of the third arm 33 in order to convert the rocking amount of the second arm 32 to drive the first arm 31.

On the other hand, the nonconversion portion 70 has a cam surface shape such that the rocking amount of the second arm 32 from the start of its rocking motion substantially to a given angle can be canceled when the rotational phase of the abutting portion 53 of the second arm 32 with respect to the cam 22 is advanced for the given angle by the variable mechanism 25.

The following is a description of the operation of the variable valve train 10.

FIG. 1 shows a state in which the rocker shaft 21 is driven on the retard side for an angle θ 1 to a neutral position N by the variable mechanism 25. In this case, the abutting portion 53 of the second arm 32 is displaced on the retard side (on the left-hand side in FIG. 1) for an angle α to a neutral point P1 with respect to the cam 22. Further, the operating portion 51 of the second arm 32 is displaced to the left as in FIG. 1.

Figure 3:
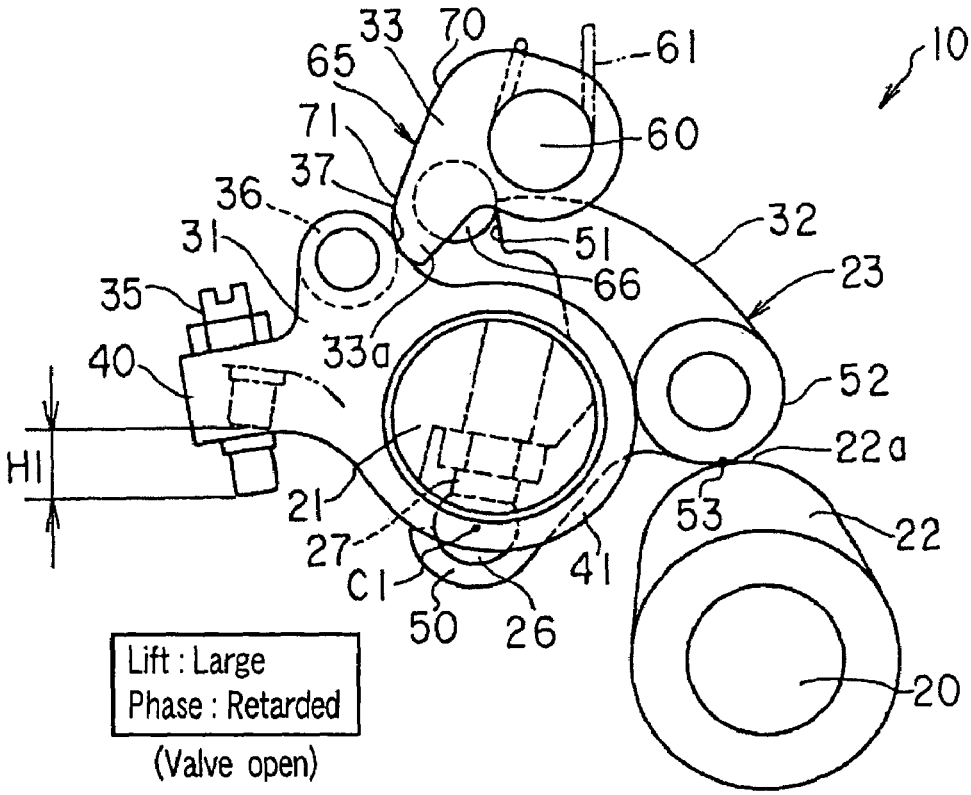
FIG. 3 is a front view showing a valve-open state of the variable valve train shown in FIG. 1 with its phase delayed.

If the camshaft 20 rotates in the direction of arrow R1 in this state so that the projection 22*a* of the cam 22 pushes up the abutting portion 53 of the second arm 32, as shown in FIG. 3, the second arm 32 rotates counterclockwise around the center Cl of the universal joint 26. Thereupon, the operating portion 51 of the second arm 32 pushes the junction portion 66, so that the third arm 33 rotates clockwise. Consequently, the conversion portion 71 of the transmission surface portion 65 pushes the power transmission portion 37, so that the first arm 31 rotates to open the valve 11.

In this case, the power transmission portion 37 is situated near the conversion portion 71 before the valve opens, as shown in FIG. 1. When the third arm 33 rotates clockwise, therefore, the nonconversion portion 70 that touches the power transmission portion 37, of the transmission surface portion 65 of the third arm 33 that serves as the transmission cam, shortens, so that the conversion portion 71 lengthens.

Accordingly, the first arm 31 starts to be driven in the direction to open the valve 11 before the cam angle widens, and besides, the power transmission portion 37 touches a long range of the conversion portion 71 as the first arm 31 is pushed in the direction of the arrow R3. Thus, a large valve lift amount Hi (shown in FIG. 3) is obtained.

Figure 4:
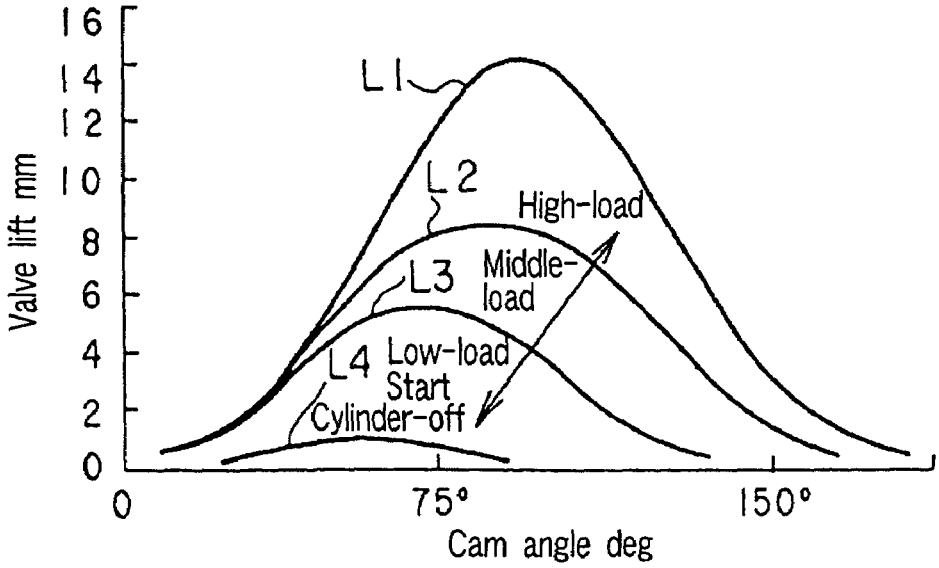
FIG. 4 is a diagram showing the relation between the cam angle and valve lift of the variable valve train shown in FIG. 1.

As indicated by curve L1 in FIG. 4, therefore, the valve lift is large, and the peak of the valve lift is retarded. In this case, the valve drive is suited for a large high-rotation, high-load intake.

Figure 5:
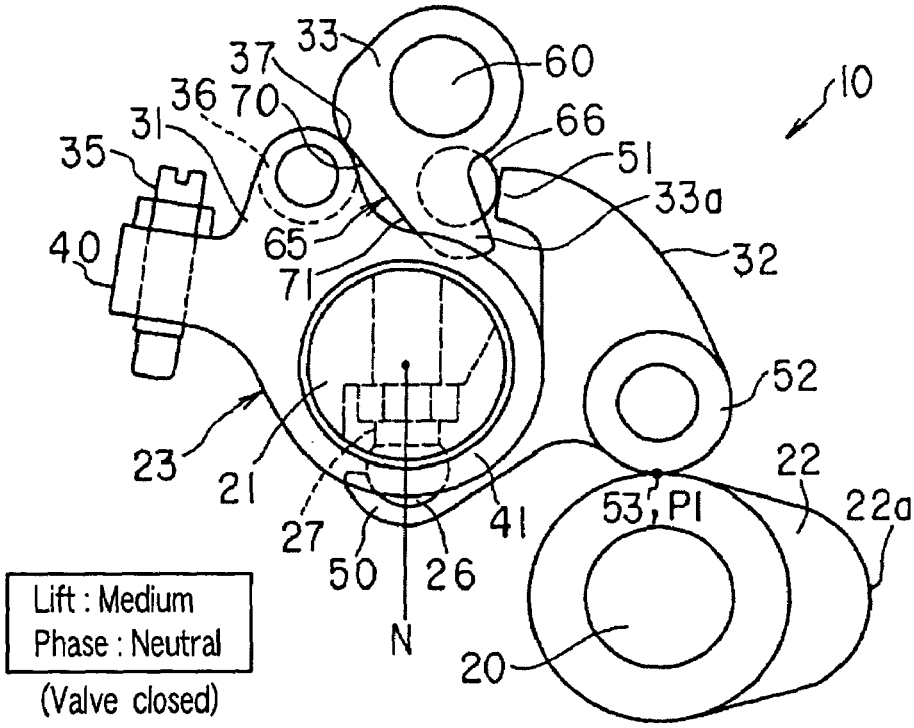
FIG. 5 is a front view showing a valve-closed state of the variable valve train shown in FIG. 1 with its phase neutral.

FIG. 5 shows a state in which the rocker shaft 21 is driven to the neutral position N by the variable mechanism 25. In this case, the abutting portion 53 of the second arm 32 touches the cam 22 at the neutral point P1. When the operating portion 51 of the second arm 32 is slightly displaced to the right of FIG. 5, compared with the position of FIG. 1, the third arm 33 slightly rotates counterclockwise. Accordingly, the nonconversion portion 70 that touches the power transmission portion 37, of the transmission surface portion 65 of the third arm 33 that serves as the transmission cam, slightly lengthens compared with the length in FIG. 1, so that the conversion portion 71 slightly shortens.

Figure 6:
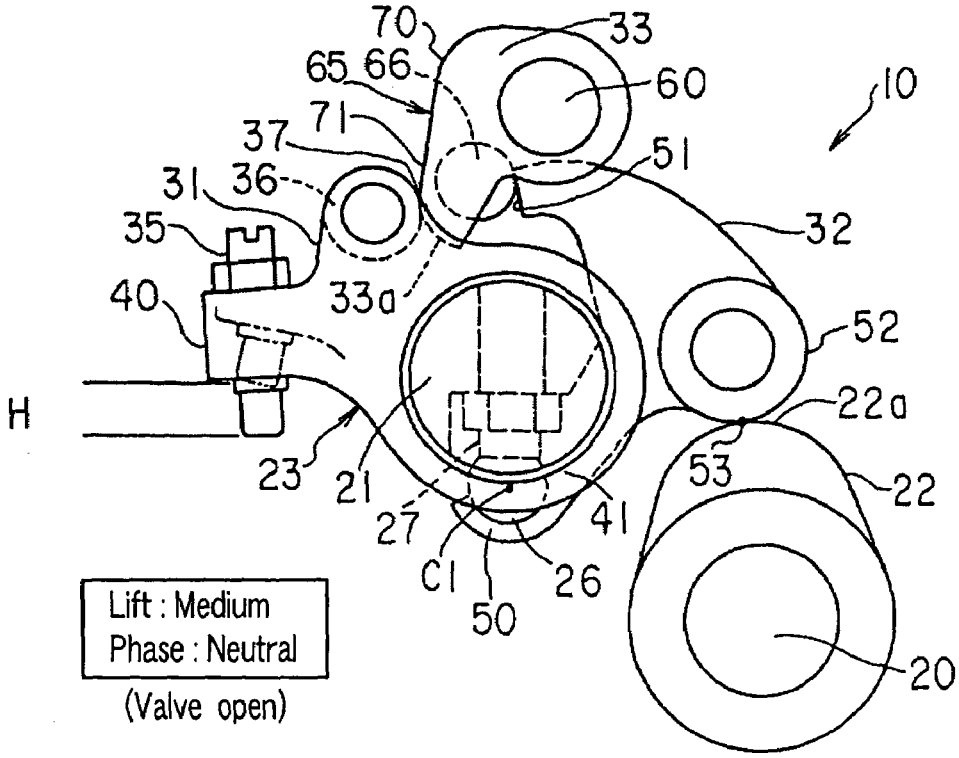
FIG. 6 is a front view showing a valve-open state of the variable valve train shown in FIG. 1 with its phase neutral.

If the camshaft 20 rotates in this state so that the projection 22*a* of the cam 22 pushes up the abutting portion 53 of the second arm 32, as shown in FIG. 6, the second arm 32 rotates counterclockwise around the center C1 of the universal joint 26. Thereupon, the operating portion 51 of the second arm 32 pushes the junction portion 66, so that the third arm 33 rotates clockwise. Consequently, the conversion portion 71 of the transmission surface portion 65 pushes the power transmission portion 37, so that the first arm 31 rotates to open the valve 11.

In other words, the distance from the power transmission portion 37 in contact with the transmission surface portion 65 to the conversion portion 71 slightly extends when the valve is closed, as shown in FIG. 5. Thus, the power transmission portion 37 abut against the conversion portion 71 after clearing the nonconversion portion 70 that is longer than in the state shown in FIG. 1. When the third arm 33 rotates clockwise, therefore, the power transmission portion 37 is pushed for a medium length by the conversion portion 71 as the third arm 33 rotates clockwise. Thus, a medium valve lift amount H2 (shown in FIG. 6) is obtained and the drive phase of the valve is neutral, as indicated by curve L2 in FIG. 4, so that the valve drive is suited for a medium-rotation, medium-load intake.

Figure 7:
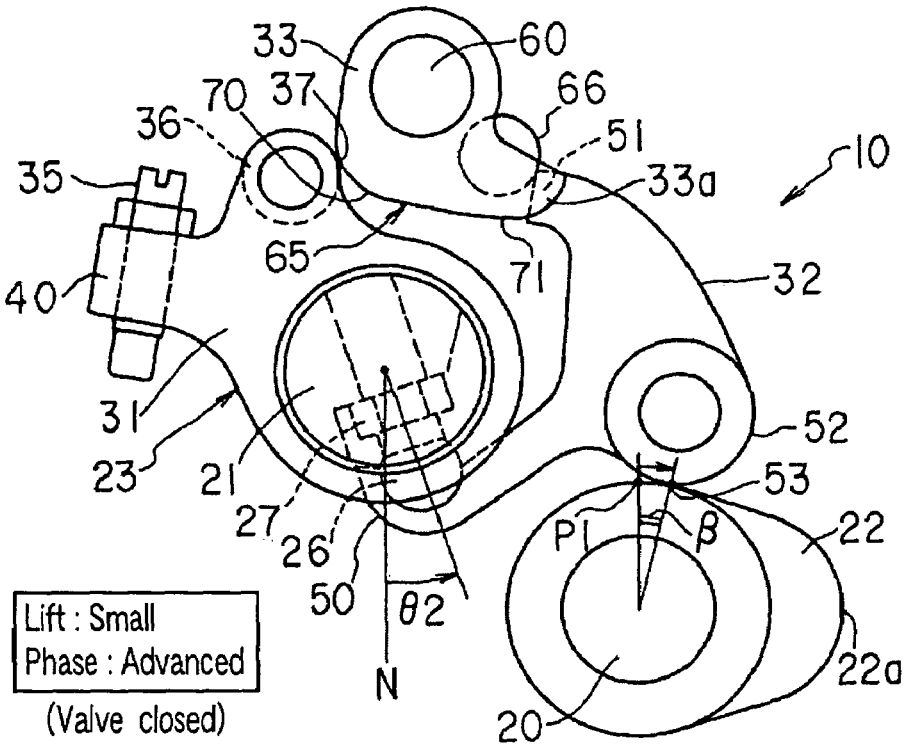
FIG. 7 is a front view showing a valve-closed state of the variable valve train shown in FIG. 1 with its phase advanced.

FIG. 7 shows a state in which the rocker shaft 21 is driven on the advance side for an angle θ 2 to the neutral position N by the variable mechanism 25. In this case, the abutting portion 53 of the second arm 32 is displaced on the advance side (on the right-hand side in FIG. 1) for an angle β to the neutral point P1 with respect to the cam 22. Further, the operating portion 51 of the second arm 32 is displaced to the right as in FIG. 7, and the third arm 33 is displaced counterclockwise. When compared with the state of FIG. 5, therefore, the nonconversion portion 70 that touches the power transmission portion 37, of the transmission surface portion 65 of the third arm 33 that serves as the transmission cam, further lengthens, so that the conversion portion 71 further shortens.

Figure 8:
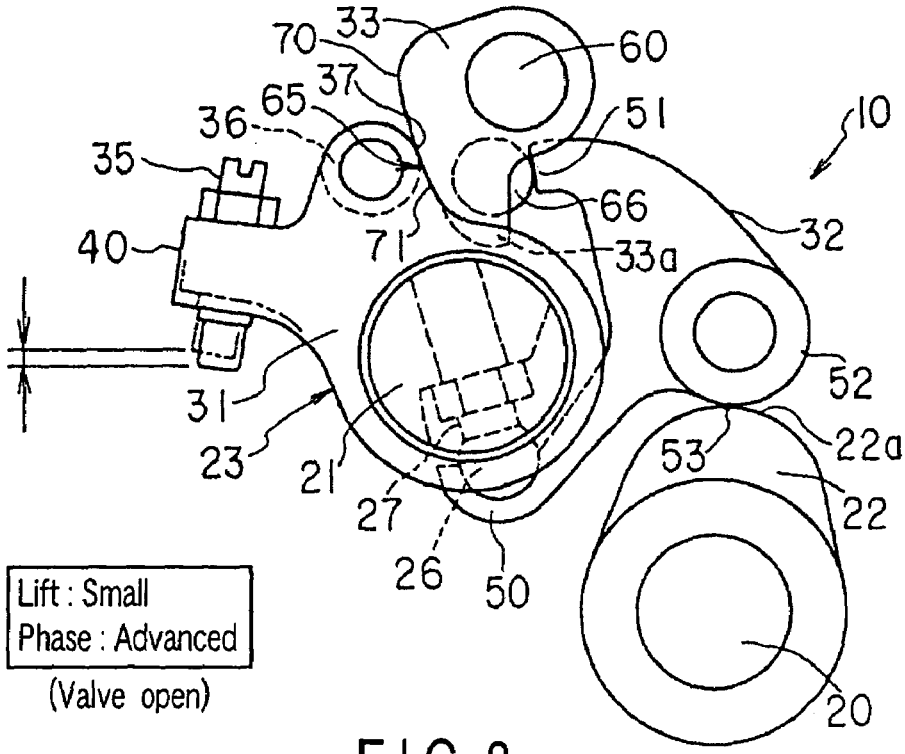
FIG. 8 is a front view showing a valve-open state of the variable valve train shown in FIG. 1 with its phase advanced.

If the camshaft 20 rotates in this state so that the projection 22*a* of the cam 22 pushes up the abutting portion 53 of the second arm 32, as shown in FIG. 8, the second arm 32 rotates counterclockwise around the center C1 of the universal joint 26. Thereupon, the operating portion 51 of the second arm 32 pushes the junction portion 66, so that the third arm 33 rotates clockwise. Consequently, the conversion portion 71 of the transmission surface portion 65 pushes the power transmission portion 37, so that the first arm 31 rotates to open the valve 11.

In this case, the period (distance) of the nonconversion portion 70 that touches the power transmission portion 37, of the transmission surface portion 65 of the third arm 33 that serves as the transmission cam, is long. When the third arm 33 rotates clockwise as the second arm 32 rocks, therefore, the distance for which the power transmission portion 37 moves on the conversion portion 71 is short. Accordingly, the rocking amount of the first arm 31 is small, so that a valve lift amount H3 (shown in FIG. 8) is reduced. Thus, the drive phase of the valve is advanced and the valve lift is reduced, as indicated by curve L3 in FIG. 4, so that the valve drive is suited for a low-rotation, low-load intake.

If the variable valve train 10 constructed in this manner is applied to the intake system, the closing side of the intake valve 11 can be continuously changed with the opening side fixed, so that a high-expansion ratio cycle can be obtained.

Further, the fuel consumption can be reduced by a synergistic effect with inertial intake. The inertial intake is a phenomenon such that pulsation of a pressure that is generated by sucking action of a piston causes an inertia in intake air in an intake pipe. Even after the bottom dead center is overreached by the piston, fresh air can be made to continue flowing into the cylinder and the volume efficiency can be enhanced by starting to close the intake valve 11 at a peak time of the intake pulsation utilizing the inertial intake. Since the peak time of the pulsation varies depending on the engine speed, the intake air amount can be increased by starting to close the intake valve 11 according to the peak time.

In the variable valve train 10 of the embodiment described above, the rocker shaft 21 is driven by the variable mechanism 25, such that advancing of the second arm 32 with respect to the cam 22 is canceled by elongation of the period during which the nonconversion portion 70 of the third arm 33 is in contact with the power transmission portion 37. Thus, the valve-opening start timing can be substantially fixed as indicated by curves L2 and L3, based on a phase from the start to end of valve opening represented by curve L1 of FIG. 4 and the valve lift amount.

According to this variable valve train 10, therefore, the valve closing time can be changed with the valve-opening start timing fixed, so that the intake air amount can be increased to obtain an effect of fuel consumption reduction by changing the valve closing time in accordance with the pulsation of the inertial intake.

Further, a satisfactory combustion state can be established by optimally controlling the air amount, and unburned components or the like are reduced to improve the quality of exhaust gas components.

In the case of a conventional continuously-variable-phase valve train, the valve-opening start timing of the intake valve is also retarded inevitably if the valve closing time is retarded. Thus, a valve overlap between intake and exhaust is reduced or removed, so that a pumping loss occurs.

According to the variable valve train 10 of the above-described embodiment, on the other hand, the valve closing time can be retarded with the valve-opening start timing fixed. Therefore, an effect of intake air amount increase can be obtained by retarding the valve closing time without failing to maintain the valve overlap. Thus, an effect of fuel consumption reduction can be obtained.

In general, the exhaust temperature lowers if excess air is supplied in a low-load mode. According to the variable valve train 10 of the foregoing embodiment, however, the intake air amount can be controlled in accordance with the operating state of the engine. Thus, the exhaust temperature can be increased by reducing the intake air amount in the low-load mode. If an engine (not shown) is provided with a catalyst for exhaust gas purification, therefore, this catalyst can be easily activated, so that the catalyst can be enabled effectively to fulfill its function. In this case, exhaust gas can be purified with the catalyst, so that the engine body can be set in a good fuel efficiency if exhaust gas components are somewhat worsened in quality. Thus, the fuel efficiency of the engine body is improved, and the exhaust gas is purified with the catalyst, so that a high fuel efficiency and exhaust gas purification can be reconciled with each other. According to this variable valve train 10, moreover, use of an intake or exhaust throttle for controlling the intake air amount can be obviated by reducing the intake air amount in the low-load mode, so that the cost can be reduced.

Figure 9:
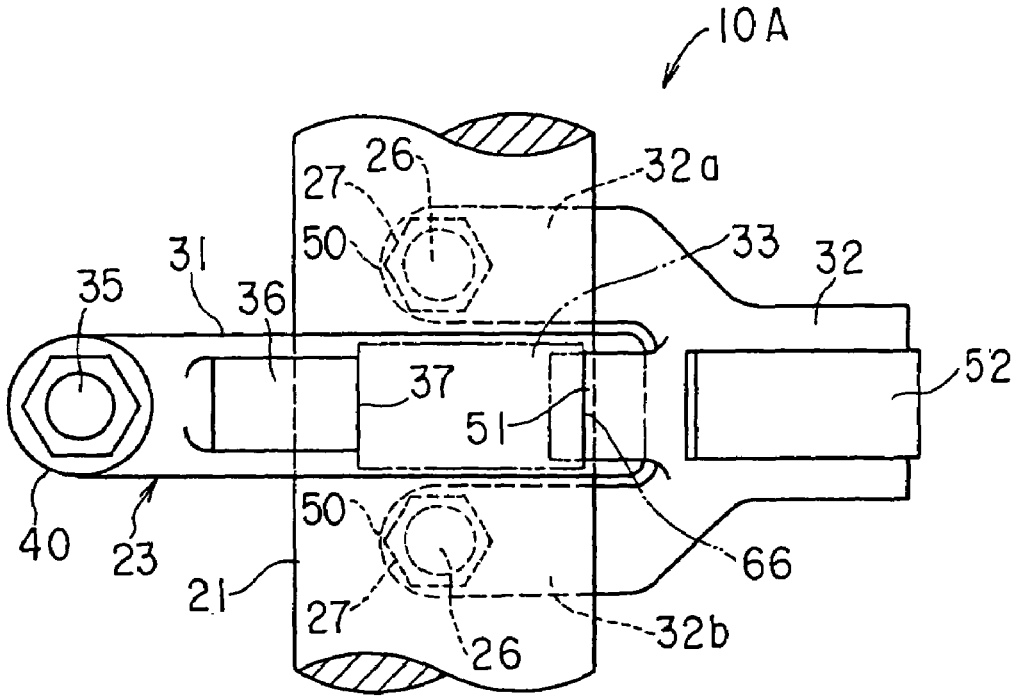
FIG. 9 is a plan view of a part of a variable valve train according to a second embodiment of the present invention.

FIG. 9 shows a variable valve train 10A according to a second embodiment of the present invention. In this variable valve train 10A, bifurcate or forked portions 32*a* and 32*b* are formed on the side of a proximal end portion 50 of a second arm 32. When the second arm 32 is in contact with the base circle 22*b*(shown in FIG. 1) of the cam 22, at least a part of a first arm 31 is situated between the forked portions 32*a* and 32*b*. Since other configurations, functions, and effects are shared with the variable valve train 10 of the foregoing first embodiment, common numerals are used to designate common portions of the embodiments, and a description of those portions is omitted.

According to the configuration in which a part of the first arm 31 is held between the forked portions 32*a* and 32*b*, as in this second embodiment, the second arm 32 can be prevented from being displaced in the axial direction of a rocker shaft 21, thereby preventing trouble such as uneven wear, even if a local load is produced in a contact portion between the second arm 32 and the cam 22 or a contact portion between the second arm 32 and a third arm 33.

Figure 10:
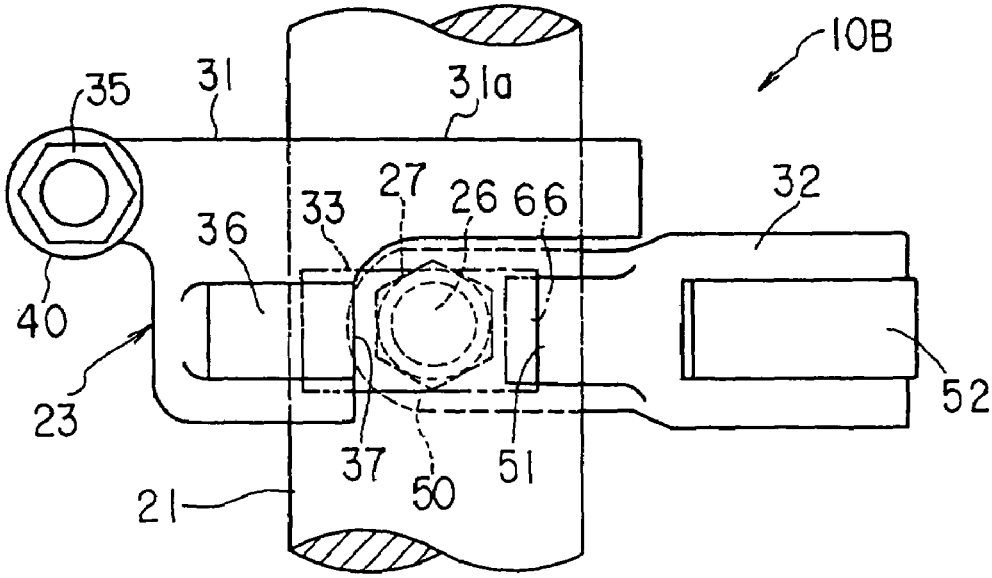
FIG. 10 is a plan view of a part of a variable valve train according to a third embodiment of the present invention.

FIG. 10 shows a variable valve train lOB according to a third embodiment of the present invention. This variable valve train 10B differs from the variable valve train 10 of the first embodiment only in that a shaft fitting portion 31*a* of a first arm 31 is not forked. Therefore, common numerals are used to designate common portions of the embodiments, and a description of those portions is omitted. In this case, the same effects of the variable valve train 10 of the foregoing first embodiment can be obtained, and the valve train can be simplified, so that the manufacturing cost and weight can be reduced.

Further, a cylinder-off state (in which the valve lift amount is minimum or zero) indicated by L4 of FIG. 4 can be established by setting the second arm 32 so that it can further advance from the state of FIG. 7 with respect to the cam 22, and an effect of reduced fuel consumption can be obtained.

The present invention is applicable to internal combustion engines, including an automotive internal combustion engine, in which the drive phase of a valve and the valve lift amount can be changed.

What is claimed is:

1. A variable valve train an internal combustion engine, comprising:

a camshaft provided for rotation in the internal combustion engine;

a rocker shaft provided in the internal combustion engine; and a rocker arm mechanism which is driven by a cam formed on the camshaft and opens and closes an intake or exhaust valve, wherein the rocker arm mechanism comprises:

a first arm rockably supported on the rocker shaft and configured to drive the intake or exhaust valve;

a second arm which is driven by the cam and rocks around a pivot on the side of the rocker shaft;

a third arm which is rockably provided on a support shaft located near the rocker shaft and is configured to be displaced to drive the first arm as the second arm rocks; and a variable mechanism which displaces the pivot for the second arm on the side of the rocker shaft, wherein the third arm has a transmission surface portion which is displaced as the second arm rocks and touches the first arm to drive the first arm, and the transmission surface portion is provided with a conversion portion at which the distance from the center of the support shaft to the transmission surface portion changes so that the rocking amount of the second arm is converted to drive the first arm.

2. A variable valve train according to claim 1, wherein the variable mechanism displaces the pivot by rotating the rocker shaft, and moves a portion of the second arm in contact with the cam in the circumferential direction of a base circle of the cam, thereby changing the rotational phase of the second arm with respect to the cam.

3. A variable valve train according to claim 2, wherein the transmission surface portion has a nonconversion portion at which the distance from the center of the support shaft to the transmission surface portion makes no substantial change in the direction of rotation of the third arm, and the nonconvertible portion cancels a rocking amount of the second arm substantially equivalent to a given angle from the start of rocking motion with the rotational phase of the second arm with respect to the cam advanced for the given angle by the variable mechanism.

4. A variable valve train an internal combustion engine, comprising:

a camshaft provided for rotation in the internal combustion engine;

a rocker shaft provided in the internal combustion engine; and a rocker arm mechanism which is driven by a cam formed on the camshaft and opens and closes an intake or exhaust valve, wherein the rocker arm mechanism comprises:

a first arm rockably supported on the rocker shaft and configured to drive the intake or exhaust valve;

a second arm which is driven by the cam and rocks around a pivot on the side of the rocker shaft;

a third arm which is rockably provided on a support shaft located near the rocker shaft and is configured to be displaced to drive the first arm as the second arm rocks;

a variable mechanism which displaces the pivot for the second arm on the side of the rocker shaft; and a spring provided on the third arm, wherein the second arm has a proximal end portion thereof rotatably supported by a connecting member provided on the side of the rocker shaft, and an abutting portion provided at a part of the second arm and an operating portion provided on the other side of the second arm abutting against the cam and the third arm, respectively, and wherein the spring urges the third arm to displace the second arm in a direction such that the abutting portion of the second arm abuts against the cam.

5. A variable valve train according to claim 4, wherein the first arm has bifurcated shaft fitting portions, through which the rocker shaft passes, that bifurcate from an end portion on the side of the valve, and a part of the second arm is situated between the bifurcated shaft fitting portions.

6. A variable valve train according to claim 4, wherein the portion near to the proximal end portion of the second arm bifurcates from the portion near to the operating portion, and a part of the first arm is situated between two branches of the bifurcated proximal end portion.

7. A variable valve train according to claim 4, wherein the first arm has a power transmission portion which abuts against the third arm and is offset in the axial direction of the rocker shaft with respect to a region for driving the valve.

* * * * *